US010300519B2

(12) United States Patent
Sakamoto et al.

(10) Patent No.: US 10,300,519 B2
(45) Date of Patent: May 28, 2019

(54) MANUFACTURING METHOD OF PRESS-FORMED ARTICLE, PRESS-FORMED ARTICLE, AND PRESS FORMING APPARATUS

(71) Applicant: Kobe Steel, Ltd., Hyogo (JP)

(72) Inventors: Kazuki Sakamoto, Kobe (JP); Yasuhiro Hayashida, Kobe (JP); Kenichi Watanabe, Kobe (JP); Junya Naitou, Kobe (JP); Kensuke Funada, Kobe (JP); Takayuki Kimura, Kobe (JP); Jiro Iwaya, Nagoya (JP)

(73) Assignee: Kobe Steel, Ltd., Hyogo (JP)

( * ) Notice: Subject to any disclaimer, the term of this patent is extended or adjusted under 35 U.S.C. 154(b) by 328 days.

(21) Appl. No.: 15/366,989

(22) Filed: Dec. 1, 2016

(65) Prior Publication Data

US 2017/0216901 A1 Aug. 3, 2017

(30) Foreign Application Priority Data

Jan. 29, 2016 (JP) ..... 2016-015907

(51) Int. Cl.
*B21D 22/02* (2006.01)
*B21J 5/08* (2006.01)
(Continued)

(52) U.S. Cl.
CPC ..... *B21D 22/02* (2013.01); *B21D 13/02* (2013.01); *B21D 22/06* (2013.01); *B21J 5/08* (2013.01); *B21D 22/22* (2013.01); *B21D 35/006* (2013.01)

(58) Field of Classification Search
CPC ..... B21D 22/02; B21D 13/02; B21D 22/06; B21D 22/22; B21D 35/006; B21J 5/08
(Continued)

(56) References Cited

U.S. PATENT DOCUMENTS

RE16,115 E * 7/1925 Schlafly ..... B21D 13/02 72/379.6
1,771,028 A * 7/1930 Bronson ..... B21D 13/02 52/630
(Continued)

FOREIGN PATENT DOCUMENTS

JP 2011-161941 A 8/2011
JP 2015-15061 A 8/2015
(Continued)

OTHER PUBLICATIONS

Extended European Search Report (EESR) dated Jul. 3, 2017, from corresponding EP Appl No. 17000007.9, 8 pp.

*Primary Examiner* — David B Jones
(74) *Attorney, Agent, or Firm* — Studebaker & Brackett PC

(57) ABSTRACT

A manufacturing method of a press-formed article includes arranging a member to be pressed between first and second dies, and relatively moving the first and second dies so as to approach each other, thereby press forming to a portion to be pressed so that a height of the portion to be pressed decreases. In the press forming step, while first bent portions in a pair each bent in a protruded shape toward the second die on the portion to be pressed are held by groove-shaped holding portions in a pair separated from each other on the second die, a second bent portion bent in a protruded shape from a position between the first bent portions toward the first die on the portion to be pressed is pressed and deformed by a pressing portion of the first die.

14 Claims, 17 Drawing Sheets

(51) Int. Cl.

| | |
|---|---|
| ***B21D 13/02*** | (2006.01) |
| ***B21D 22/06*** | (2006.01) |
| *B21D 22/22* | (2006.01) |
| *B21D 35/00* | (2006.01) |

(58) Field of Classification Search
USPC ..... 72/352
See application file for complete search history.

(56) References Cited

U.S. PATENT DOCUMENTS

| | | | | | |
|---|---|---|---|---|---|
| 4,840,054 | A * | 6/1989 | Sjogren | B21D 13/02 | 72/382 |
| 5,174,146 | A * | 12/1992 | Heurteboust | B21D 51/383 | 72/348 |
| 8,402,804 | B2 * | 3/2013 | Nakao | B21D 22/06 | 72/347 |

FOREIGN PATENT DOCUMENTS

| | | | |
|---|---|---|---|
| WO | 2014/208244 | A1 | 12/2014 |
| WO | 2015/147297 | A1 | 10/2015 |

* cited by examiner

MANUFACTURING METHOD OF PRESS-FORMED ARTICLE, PRESS-FORMED ARTICLE, AND PRESS FORMING APPARATUS

BACKGROUND OF THE INVENTION

Field of the Invention

The present invention relates to a manufacturing method of a press-formed article, a press-formed article, and a press forming apparatus.

Description of the Related Art

Hitherto, there is known a technology of manufacturing frame members for automobiles by press forming applied metal plates. In this application for the frame members for automobiles, there is an increasing need for a metal plate constant in the plate thickness as well as a metal plate reinforced by partially forming a thickened portion increased in a plate thickness. A technology of manufacturing a structural component partially increased in the thickness in this way by press forming a metal plate is disclosed in Japanese Patent Application Laid-Open No. 2011-161941 (JP 2011-161941 A).

A method of preparing a flat plate member on which a microbead in a wave shape constructed by a continuous protruded and recessed portion is formed, and press forming the flat plate member for manufacturing an automobile pillar is disclosed in JP 2011-161941 A. This method can be used to press the microbead in the thickness direction for increasing the plate thickness, thereby manufacturing the partially thickened pillar.

The manufacturing method of a pillar disclosed in JP 2011-161941 A includes bending to the flat plate member, thereby forming the microbead in advance, and pressing the microbead to form the thickened portion. In this case, strain is generated by stretching the material in the bending for forming the microbead before the pressing, and, as a result, the thickness is decreased in the plate material. Therefore, even if the microbead is pressed in the subsequent process, an intended thickened amount is not realized, and large decreases in the thickness are locally generated, which may constitute start points of cracks in the press-formed article. The method disclosed in JP 2011-161941 A may not be used to appropriately obtain a desired shape as described before.

SUMMARY OF THE INVENTION

The present invention has been made in view of the above-mentioned problem, and therefore has an object to provide a manufacturing method of a press-formed article and a press forming apparatus for more appropriately obtaining a desired shape, and a press-formed article manufactured by the manufacturing method of a press-formed article.

A method of manufacturing a press-formed article according to one aspect of the present invention is a method of manufacturing a press-formed article by press forming a bent-shaped portion to be pressed that is formed on a plate-shaped member to be pressed. The manufacturing method of a press-formed article includes: the steps of arranging the member to be pressed between a first die and a second die; and press forming the portion to be pressed so that a height of the portion to be pressed decreases by moving the first die and the second die relative to each other so as to approach each other. In the press forming step, while first bent portions in a pair each bent in a protruded shape toward the second die on the portion to be pressed are held by groove-shaped holding portions in a pair provided so as to be separated from each other on the second die, a second bent portion bent in a protruded shape from a position between the first bent portions toward the first die on the portion to be pressed is pressed and deformed by a pressing portion of the first die In the manufacturing method of a press-formed article, while the first bent portions are held by the holding portions of the second die, the second bent portion is pressed by the pressing portion of the first die during the press forming of the portion to be pressed. As a result, the material can be caused to flow over the entire portion to be pressed during the press forming, thereby preventing the local decrease in the thickness, which may be the start point of the crack in the press-formed article. Thus, with the manufacturing method of a press-formed article, a press-formed article in a desired shape can appropriately be obtained.

In the manufacturing method of a press-formed article, in the press forming step, the portion to be pressed may be thickened. As a result, a press-formed article increased in strength in the portion to be pressed can be manufactured.

In the manufacturing method of a press-formed article, in the press forming step, the portion to be pressed may be press formed until the height of the portion to be pressed disappears after the press forming. As a result, the press-formed article increased in the strength can be manufactured.

In the manufacturing method of a press-formed article, in the press forming step, the portion to be pressed may be press formed so that the portion to be pressed after the press forming has a bent shape less in the height than that before the press forming. As a result, the press-formed article having the bent shape can be manufactured. The "bent shape" means an arbitrary shape bent so as to swell out in the thickness direction of a plate material.

In the press forming step, a surrounding portion of the portion to be pressed out of the member to be pressed may be sandwiched by the first die and the second die.

As a result, the entrance of the material toward the surrounding portion is suppressed during the press forming.

In the manufacturing method of a press-formed article, in the press forming step, the first bent portions and the second bent portion may be formed on the portion to be pressed. The formation of the first and second bent portions on the portion to be pressed during the press forming in this way can eliminate the necessity of the formation of the first and second bent portions in advance before the press forming, thereby increasing the efficiency of the manufacturing process.

In the manufacturing method of a press-formed article, the first die may include a first die center portion including the pressing portion, and a first die surrounding portion formed separately from the first die center portion and configured to move independently of the first die center portion. In the press forming step, after the first die surrounding portion is moved toward the second die to form the first bent portions and the second bent portion on the portion to be pressed, the second bent portion may be pressed and deformed by the pressing portion. As a result, the first die center portion can be started to move after the second bent portion is formed on the portion to be pressed during the press forming, thereby using the pressing portion to surely press the second bent portion.

In the manufacturing method of a press-formed article, in the press forming step, the portion to be pressed on which the first bent portions and the second bent portion are formed in advance may be press formed.

The first bent portions can more surely be formed at the position opposing the holding portions of the second die, and the second bent portion can more surely be formed at the position opposing to the pressing portion of the first die by forming the first and second bent portions on the portion to be pressed in advance before the press forming in this way. As a result, the first bent portions can more surely be held by the holding portions, and the second bent portion can more surely be pressed by the pressing portion during the press forming.

In the manufacturing method of a press-formed article, a distance between the pressing portion and the second die and a distance between the holding portions and the first die may be the same when the press forming step is completed. As a result, the thickness of the portion to be pressed can be uniform.

In the manufacturing method of a press-formed article, in the press forming step, a protruded and recessed region may be provided on the portion to be pressed. As a result, the press-formed article reinforced by the protruded and recessed region, and thus increased in the strength can be manufactured.

The manufacturing method of a press-formed article may further include a step of flattening the protruded and recessed region after the press forming. When the portion to be pressed is directly formed into a flat shape, a buckling of the plate material may be generated. In contrast, the buckling of the plate material can be prevented by carrying out the machining in such a sequence that, after the protruded and recessed region is once formed on the portion to be pressed, the protruded and recessed region is flattened.

In the manufacturing method of a press-formed article, the member to be pressed may be formed by hot pressing. As described before, in the manufacturing method of a press-formed article, the flow of the material in the portion to be pressed can be controlled during the press forming, and the press-formed article in a desired shape can easily be obtained even in the case of the hot pressing in which the material is likely to flow.

A press-formed article according to another aspect of the present invention is manufactured by the manufacturing method of a press-formed article. A decrease in the strength caused by generation of local decrease in the thickness during the pressing can be prevented by forming the press-formed article in a desired shape.

A press forming apparatus according another aspect of the present invention is a press forming apparatus for manufacturing a press-formed article by press forming a bent-shaped portion to be pressed that is formed on a plate-shaped member to be pressed. The press forming apparatus includes: a first die that includes a press forming surface; a second die that includes a press forming surface opposing the press forming surface and forms a press space between the first die and the second die in which the portion to be pressed is stored; and a driving section that moves the first die and the second die relative to each other so as to approach each other, thereby decreasing the press space. Groove-shaped holding portions in a pair are provided on the second die so as to be separated from each other and hold two first bent portions on the portion to be pressed. The first die a pressing portion that is positioned between the two holding portions, has a shape protruding toward the second die, and presses a second bent portion on the portion to be pressed.

In the press forming apparatus, while the first bent portions are held by the holding portions of the second die, the second bent portion can be pressed by the pressing portion of the first die during the press forming. As a result, the material can be caused to flow over the entire portion to be pressed during the press forming, thereby preventing the local decrease in the thickness, which may be the start point of the crack in the press-formed article. Thus, with the press forming apparatus, a press-formed article in a desired shape can appropriately be manufactured.

In the press forming apparatus, the first die may include a first die center portion including the pressing portion, and a first die surrounding portion formed separately from the first die center portion and configured to move independently of the first die center portion. As a result, the first die center portion can be started to move after the second bent portion is formed on the portion to be pressed during the press forming, thereby using the pressing portion to surely press the second bent portion.

EFFECTS OF INVENTION

The present invention can provide a manufacturing method of a press-formed article and a press forming apparatus for more appropriately obtaining a desired shape, and a press-formed-article manufactured by the manufacturing method of a press-formed article.

DESCRIPTION OF THE PREFERRED EMBODIMENTS

Hereinafter, embodiments of the present invention will be described in detail with reference to drawings.

First Embodiment

[Press Forming Apparatus]

Figure 1:
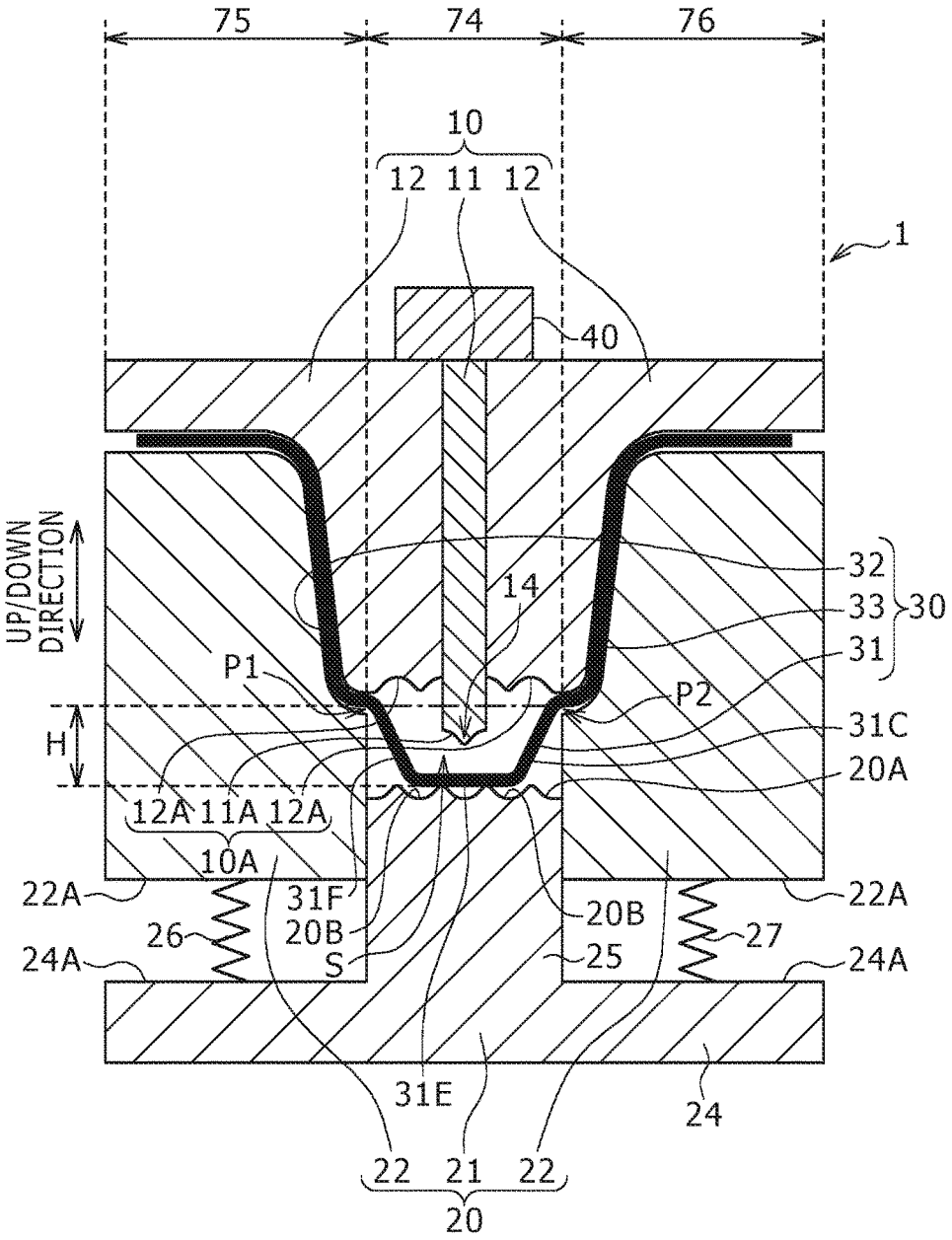
FIG. 1 is a view of the configuration of a press forming apparatus according to a first embodiment of the present invention.

First, a description is given of a configuration of a press forming apparatus 1 according to a first embodiment of the present invention mainly with reference to FIG. 1. The press forming apparatus 1 is an apparatus for manufacturing a press-formed article in a hat shape in the cross sectional view by applying press forming to a portion to be pressed 31 in a bent shape formed on a member to be pressed 30 in a plate shape. On this occasion, the "portion to be pressed" is a portion to be deformed by the pressing on the member to be pressed. The press forming apparatus 1 includes a first die 10, which is an upper die, a second die 20, which is a lower die, and a driving section 40. Hereinafter, an up/down direction in FIG. 1 is simply referred to as "up/down direction". Note that the up/down direction does not always need to be the gravity direction. The second die 20 opposes the first die 10 in the up/down direction. The driving section 40 moves the first die 10 so as to approach the second die 20 or so as to depart from the second die 20 in the up/down direction.

The member to be pressed 30 is a plate formed of a metal material such as hard steel, soft steel, aluminum, titanium, and copper. The member to be pressed 30 includes the portion to be pressed 31 to be thickened by the press forming and surrounding portions 32 and 33 each bent into an L shape in the cross sectional view, and connected to respective ends of the portion to be pressed 31, and these portions are connected to one another in a single plate shape. It should be noted that the surrounding portions 32 and 33 are portions not to be pressed by the first die 10 and the second die 20.

The portion to be pressed 31 has a curved shape curved into a trapezoidal shape in the cross sectional view as shown in FIG. 1. More specifically, the portion to be pressed 31 has the trapezoidal shape having a height H in the up/down direction, and includes a first flat plate portion 31E, which is the upper base of the trapezoid, and second flat plate portions 31F and 31C in a pair, which are legs of the trapezoid, and are connected to respective ends of the first flat plate portion 31E. The second flat plate portions 31F and 31C are connected to the surrounding portions 32 and 33, respectively, so as to form approximately the same angle as each other, and, as a result, the portion to be pressed 31 has a shape of an isosceles trapezoid.

A line length of the portion to be pressed 31 before the pressing is longer than a length along an undulation of a protruded and recessed region 91A, described later, of a press-formed article 90 shown in FIG. 12. On this occasion, the "line length" of the portion to be pressed 31 is a length from one end of the portion to be pressed 31 to the other end along the portion to be pressed 31, and a line length, which is a sum of the first and second flat plate portions 31E, 31F, and 31C. Therefore, when the press forming is applied to the portion to be pressed 31 so as to form the protruded and recessed region 91A (in other words, so that the height H of the trapezoid disappears), the line length of the portion to be pressed 31 can be decreased, thereby thickening the portion to be pressed 31. In other words, the second flat plate portions 31F and 31C of the portion to be pressed 31 serve as portions for securing the line length for the thickening.

Figure 2:
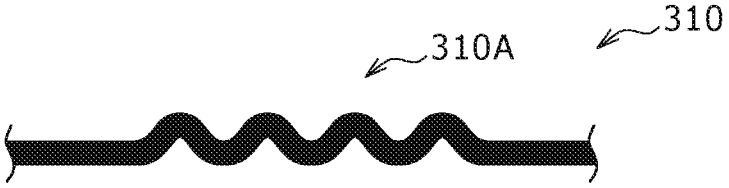
FIG. 2 is a view of a microbead formed on a portion to be pressed.
Figure 3:
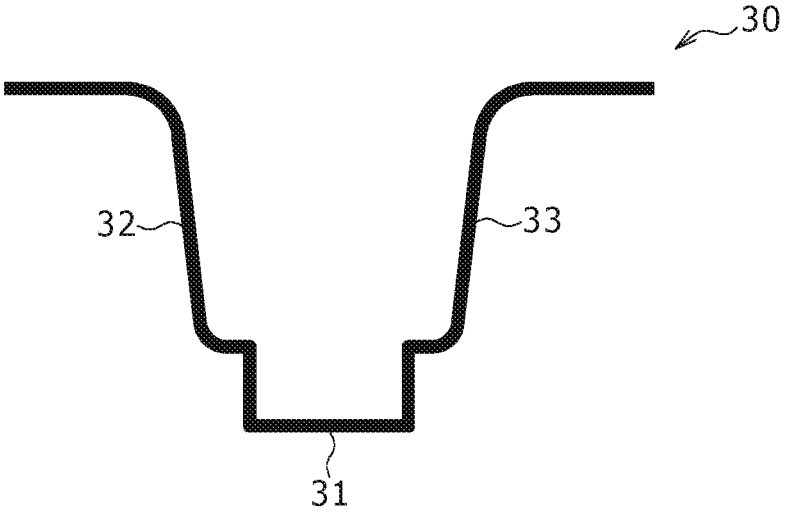
FIG. 3 is a view of a shape of a member to be pressed according to a variation of the first embodiment.
Figure 4:
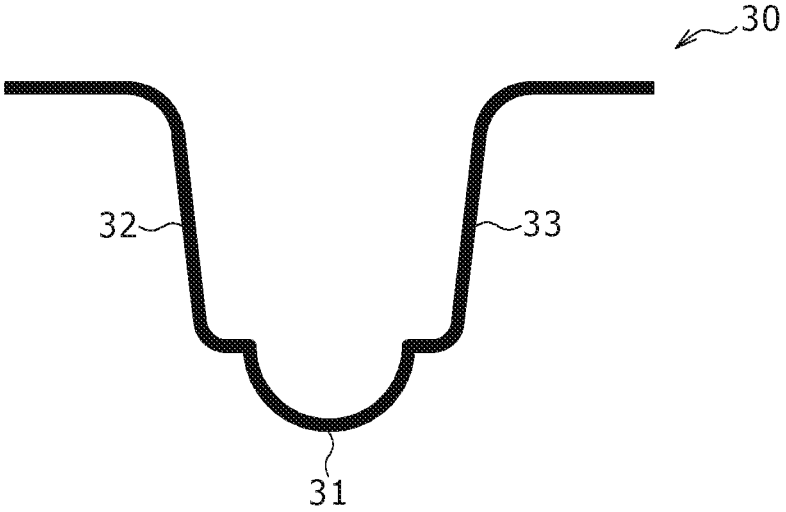
FIG. 4 is a view of the shape of the member to be pressed according to another variation of the first embodiment.

The portion to be pressed 31 is configured to have such a curved shape, thereby sufficiently securing the line length required for the thickening. More specifically, a longer line length can be secured compared with the case where a microbead 310A formed by a continuous protruded and recessed region is formed on a portion to be pressed 310 in a flat plate shape as shown in a comparative example of FIG. 2. In other words, the length (line length) from one end of the portion to be pressed 31 to the other end along the portion to be pressed 31 can be greatly increased, thereby increasing a thickened amount of the portion to be pressed 31 according to this embodiment compared with the comparative example in which the microbead 310A is formed. Moreover, the shape of the portion to be pressed 31 is not limited to the trapezoidal shape in the cross sectional view as described above, may be a shape bent in a rectangular shape in the cross sectional view as in FIG. 3, or may be bent in an arc (arch) shape in the cross sectional view as shown in FIG. 4.

Figure 8:
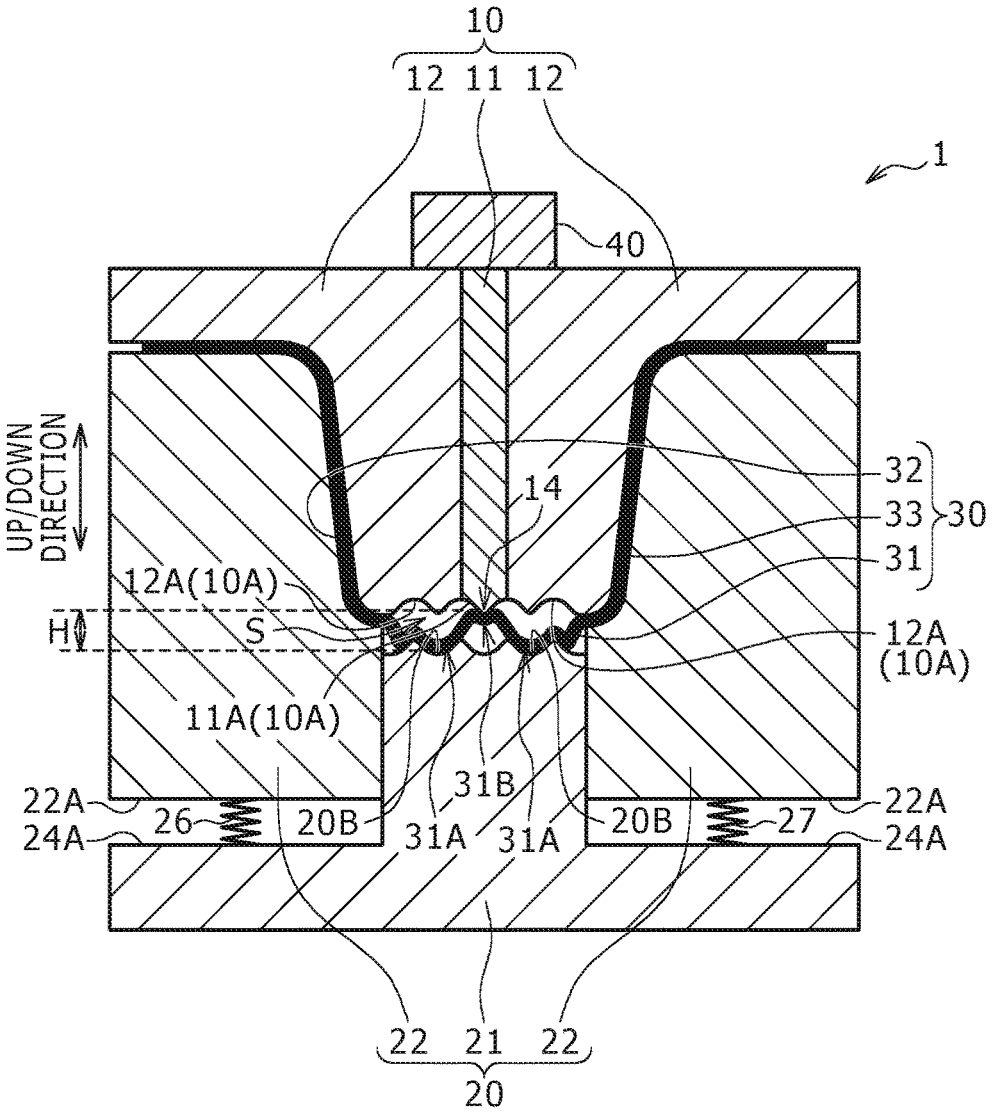
FIG. 8 is a view of a state where the second bent portion formed on the portion to be pressed is pressed by a pressing portion of an upper die.

The first die 10 includes an upper press forming surface 10A in a wave shape for pressing one main surface of the portion to be pressed 31 as shown in FIG. 1. The first die 10 includes a first die center portion 11 arranged at the center of the first die 10 and first die surrounding portions 12 formed separately from the first die center portion 11, and arranged on respective sides of the first die center portion 11 so as to sandwich side surfaces of the first die center portion 11. The upper press forming surface 10A is constructed by a first forming surface 11A provided at a bottom end of the first die center portion 11 and second forming surfaces 12A provided at respective bottom ends of the first die surrounding portions 12. Moreover, the upper press forming surface 10A has a surface including a continuous protruded and recessed region by aligning the height of the first forming surface 11A and the height of the second forming surfaces 12A to each other as shown in FIG. 8.

Moreover, the first die 10 includes the upper press forming surface 10A, and includes an upper forming die portion 74, which is a portion for applying the press forming to the portion to be pressed 31, and upper sandwiching die portions 75 and 76 for sandwiching and fixing the surrounding portions 32 and 33 as shown in FIG. 1. The upper forming die portion 74 is formed integrally by the first die center portion 11 and parts of the first die surrounding portions 12. The upper sandwiching die portions 75 and 76 are formed as portions of the first die surrounding portions 12.

The first die center portion 11 and the first die surrounding portions 12 are configured to be moved by the driving section 40 in the up/down direction independently of each other. In other words, only the first die surrounding portions 12 can be moved in the up/down direction while the position of the first die center portion 11 is fixed, and only the first die center portion 11 can be moved in the up/down direction while the positions of the first die surrounding portions 12 are fixed.

A pressing portion 14 in a shape protruding downward toward the second die 20 is provided on the first forming surface 11A of the first die center portion 11. The pressing portion 14 is a center portion of the first forming surface 11A, and protrudes downward more than portions on both sides thereof. A second bent portion 31B bending in a protruded shape toward the first die 10 is formed on the portion to be pressed 31 during the press forming as shown in FIG. 7, and the second bent portion 31B can be pressed by the pressing portion 14.

The second die 20 includes a lower press forming surface 20A in a wave shape opposing the upper press forming surface 10A of the first die 10 as shown in FIG. 1. The second die 20 includes a second die center portion 21, and second die surrounding portions 22 formed independently of the second die center portion 21.

Figure 9:
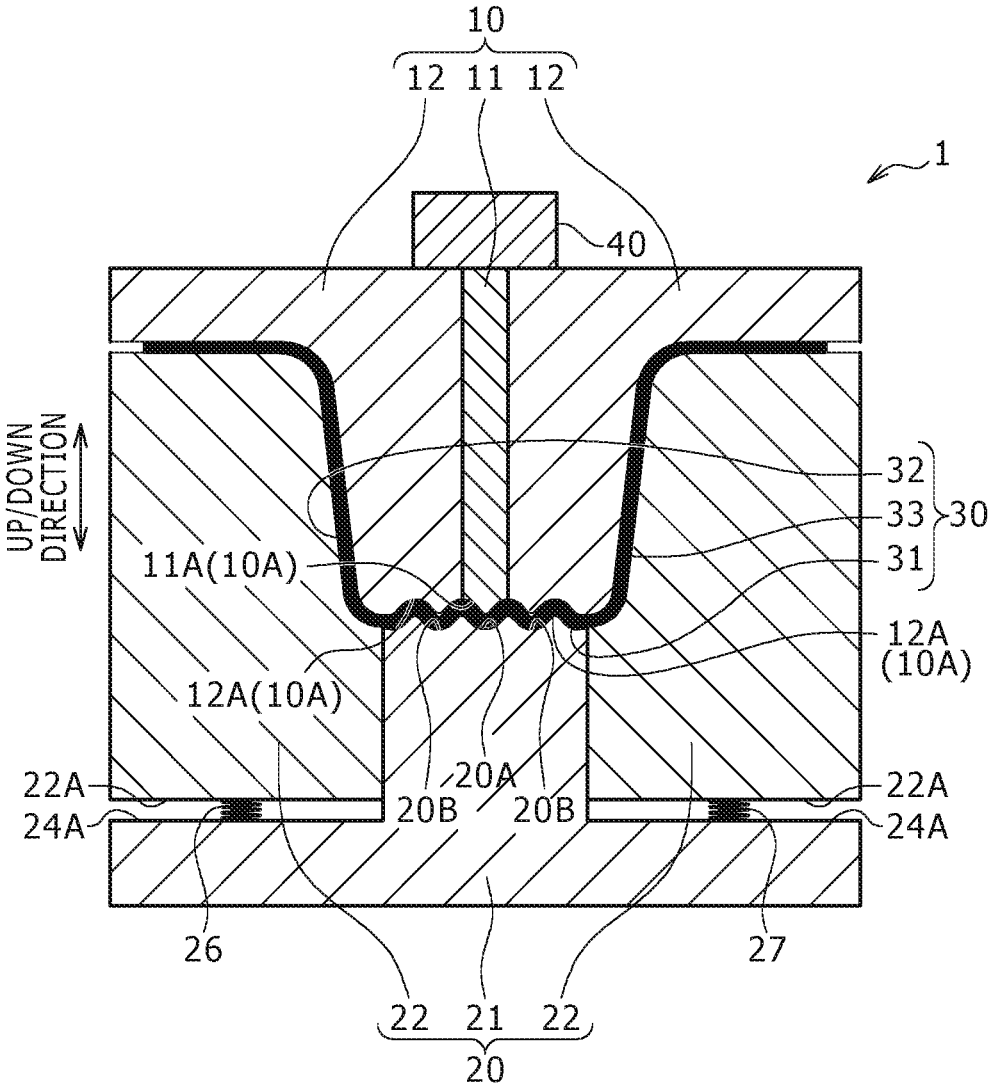
FIG. 9 is a view of a state where a protruded and recessed region is formed on the portion to be pressed.

The second die center portion 21 includes a support portion 24 placed on a horizontal surface, and a forming portion 25 standing upward from an approximate center of the support portion 24 toward the first die 10. The lower press forming surface 20A is provided on a top of the forming portion 25. The lower press forming surface 20A is formed of a continuous protruded and recessed region as the upper press forming surface 10A, and has a length the same as the width of the protruded and recessed region 91A formed on the press-formed article 90 shown in FIG. 12. Moreover, protruded portions of the upper press forming surface 10A oppose recessed portions of the lower press forming surface 20A, and recessed portions of the upper press forming surface 10A oppose protruded portions of the lower press forming surface 20A. Therefore, a protruded and recessed region along the protruded and recessed surfaces of the upper and lower press forming surfaces 10A and 20A can be formed on the portion to be pressed 31 by using the upper press forming surface 10A and the lower press forming surface 20A to apply the press forming to the portion to be pressed 31 in the wave shape as shown in FIG. 9.

Figure 7:
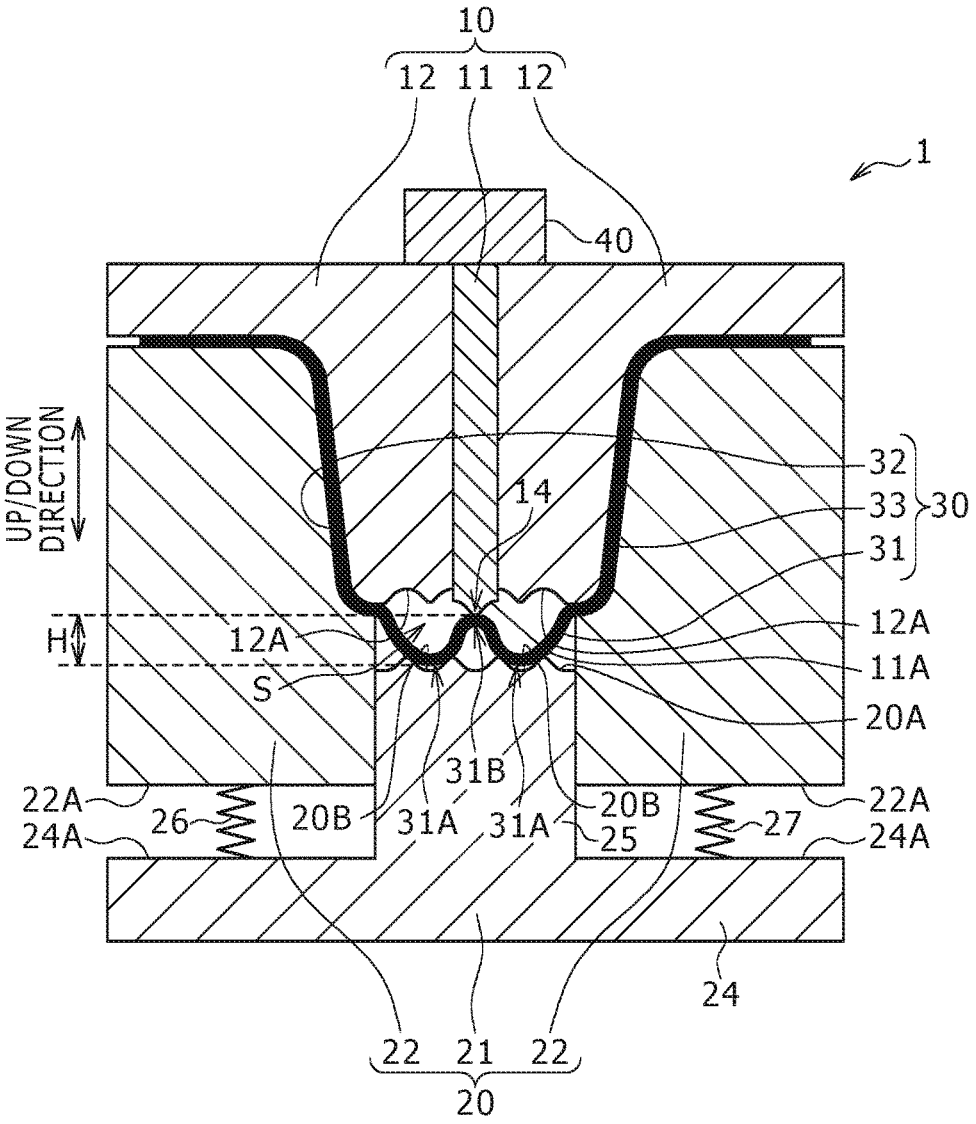
FIG. 7 is a view of a state where first and second bent portions are formed on the portion to be pressed of the member to be pressed.

Two first bent portions 31A each bent in a protruded shape toward the second die 20 are formed on the portion to be pressed 31 so as to be separated from each other on the portion to be pressed 31 during the press forming as shown in FIG. 7. The two first bent portions 31A can be held by groove-shaped holding portions 20B in a pair provided on the lower press forming surface 20A. The holding portions 20B are provided so as to be separated from each other, thereby positioning on respective sides of a recessed groove positioned at the center of the lower press forming surface 20A, and are positioned outside the pressing portion 14 of the first die 10. In other words, the pressing portion 14 is positioned between the two holding portions 20B.

The second die surrounding portions 22 are arranged so as to oppose the first die surrounding portions 12 in the up/down direction, and sandwich the surrounding portions 32 and 33 in gaps with the first die surrounding portions 12 as illustrated in FIG. 1. Bottom end surfaces 22A of the second die surrounding portions 22 are connected to one ends of elastic members 26 and 27 such as springs, and the second die surrounding portions 22 are connected to a top surface 24A of the support portion 24 via the elastic members 26 and 27. The second die surrounding portions 22 are positioned so as to form steps on a upper side with respect to the forming portion 25 of the second die center portion 21 in the state before the start of the pressing shown in FIG. 1, and a press space S for storing the portion to be pressed 31 is formed between the upper press forming surface 10A and the lower press forming surface 20A as a result. Then, the first die surrounding portions 12 move down, thereby downward pressing the second die surrounding portions 22, the elastic members 26 and 27 thus contract, and the second die surrounding portions 22 move down while sliding over side surfaces of the forming portion 25. As a result, the press space S gradually decreases, and the portion to be pressed 31 is pressed.

In the second die 20, the second die center portion 21 corresponds to a lower forming die portion for applying, together with the upper forming die portion 74, the press forming to the portion to be pressed 31, and the second die surrounding portions 22 correspond to lower sandwiching die portions for sandwiching and fixing, together with the upper sandwiching die portions 75 and 76, the surrounding portions 32 and 33. In other words, the lower forming die portion and the lower sandwiching die portions are constructed independently of each other according to this embodiment.

The driving section 40 is used to move down the first die 10 so as to approach the second die 20. As a result, the press space S can be decreased, thereby applying the press forming to the portion to be pressed 31. The driving section 40 is arranged at a top portion of the first die 10, and includes a reciprocally movable hydraulic or electric piston. The first die center portion 11 and the first die surrounding portions 12 can be upward/downward moved independently of each other by using the piston to press these portions.

[Manufacturing Method of Press-Formed Article]

A description will now be given of a process of using the press forming apparatus 1 to apply the press forming to the portion to be pressed 31 mainly referring to a flowchart shown in FIG. 5 and FIGS. 1 and 6 to 10. FIGS. 1 and 6 to 10 sequentially show a process of moving down the first die 10 toward the second die 20, thereby decreasing the press space S to apply the press forming to the portion to be pressed 31. Moreover, a description is given of the hot pressing for applying the press forming to the member to be pressed 30 softened by heating according to this embodiment, but this manufacturing method is not limited to the hot pressing, and can be similarly used for cold working.

First, the member to be pressed 30 in the flat plate shape formed of various metal materials such as hard steel is prepared, and the member to be pressed 30 is machined to form the portion to be pressed 31 bent in the trapezoidal shape. Then, the member to be pressed 30 is heated in an electric furnace, or is heated by supplying an electric current, thereby being brought into the softened state.

Then, Step S10 for arranging the member to be pressed 30 in the press forming apparatus 1 is carried out. In Step S10, the member to be pressed 30 softened by the heating is arranged between the first die 10 and the second die 20. On this occasion, as shown in FIG. 1, the surrounding portions 32 and 33 are arranged between the first die surrounding portions 12 and the second die surrounding portions 22, and the portion to be pressed 31 is arranged in the press space S.

Then, Step S20 for applying the press forming to the member to be pressed 31 is carried out. In Step S20, the first die 10 is moved so as to approach the second die 20 to decrease the press space S, thereby applying the press forming to the portion to be pressed 31 so that the height H of the portion to be pressed 31 decreases. In Step S20, a bending step S21 for forming the first bent portions 31A and the second bent portion 31B on the portion to be pressed 31 as shown in FIG. 7, and a deformation step S22 for pressing the second bent portion 31B to deform while the first bent portion 31A are held by the holding portions 20B as shown in FIG. 8 are carried out in sequence.

Figure 6:
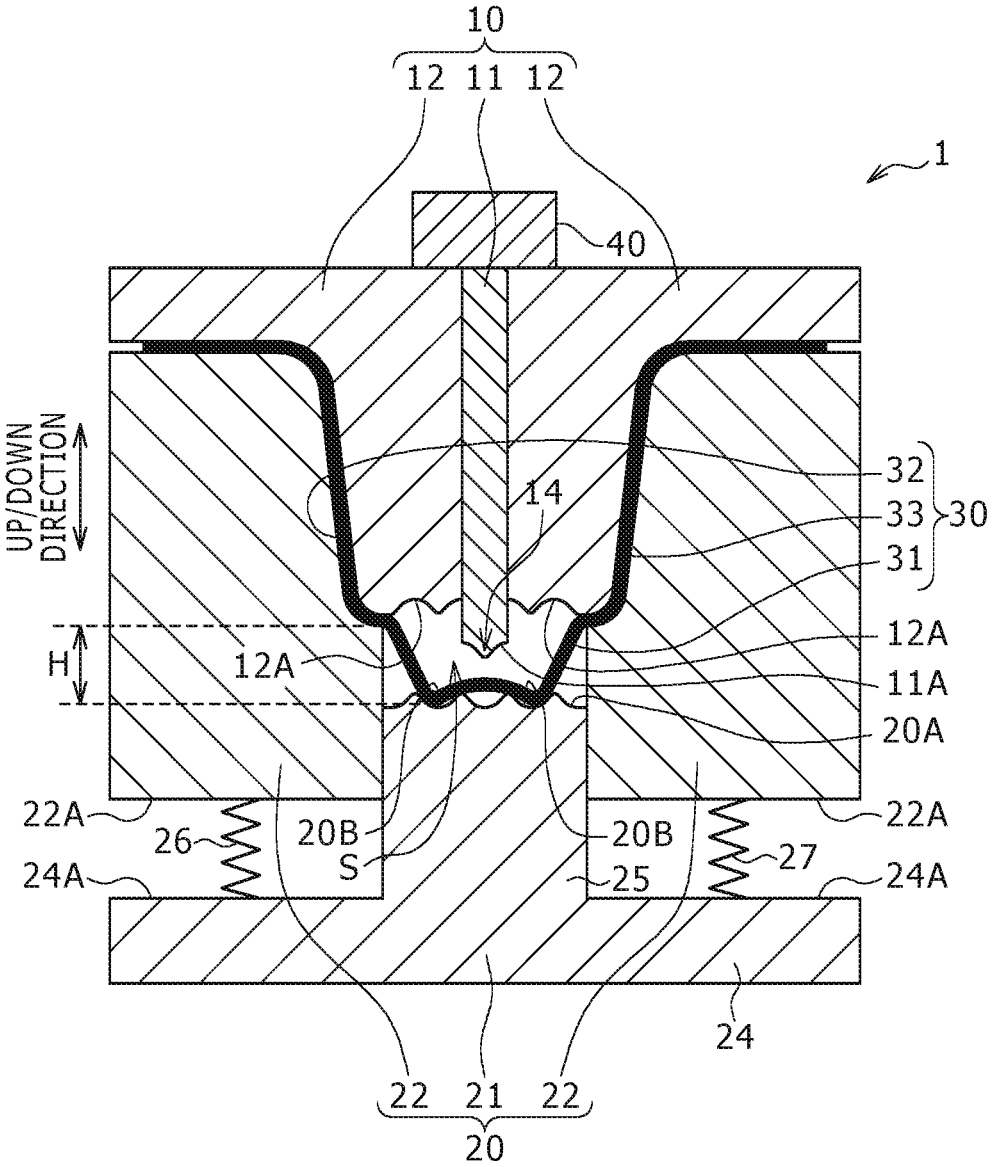
FIG. 6 is a view of a state where surrounding portions in the member to be pressed are sandwiched by dies.

First, in the bending step S21, the first die surrounding portions 12 are moved downward toward the second die surrounding portions 22 by the driving section 40 while the position of the first die center portion 11 is fixed in the state of FIG. 1. As a result, the surrounding portions 32 and 33 are sandwiched and fixed by the first die surrounding portions 12 and the second die surrounding portions 22 as shown in FIG. 6. As a result, a flow of the material toward the surrounding portions 32 and 33 are prevented.

In this state, the press space S is decreased by further moving downward the first die surrounding portions 12, thereby gradually decreasing the height H of the portion to be pressed 31. Then, when the height H of the portion to be pressed 31 becomes equal to or less than a predetermined value, the portion to be pressed 31 bends, and the pair of first bent portions 31A each bent in the protruded shape toward the second die 20 and the second bent portion 31B bent in the protruded shape from the position between the pair of the first bent portions 31A toward the first die 10 are formed on the portion to be pressed 31 as shown in FIG. 7. On this occasion, the material between the holding portions 20B and the surrounding portions 32 and 33 flows toward the holding portions 20B, and further flows from the holding portions 20B toward the pressing portion 14 as the first die 10 approaches the second die 20 while the surrounding portions 32 and 33 are fixed. As a result, the first bent portions 31A swell out so as to fit into the recessed grooves of the holding portions 20B, and are thus fixed in position as shown in FIG. 7, and the second bent portion 31B swells out upward so as to oppose the pressing portion 14 of the first die 10.

Figure 10:
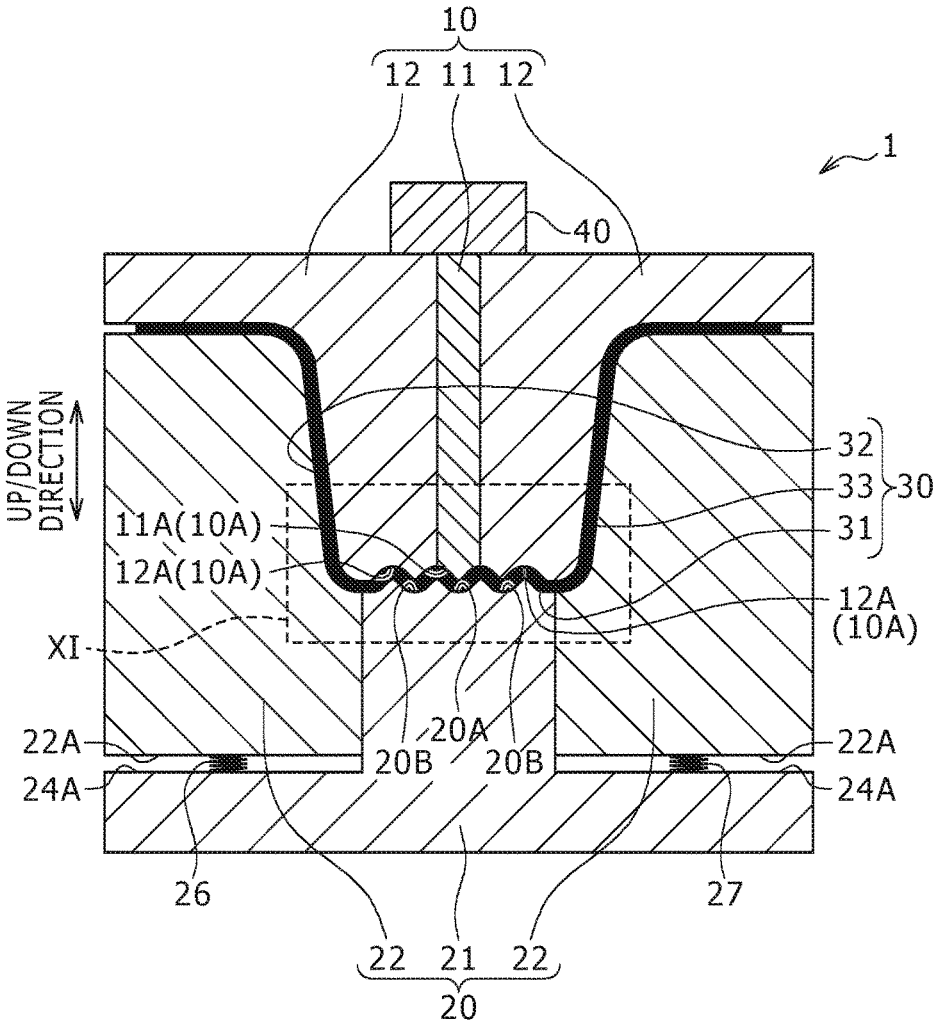
FIG. 10 is a view of a state where press forming for the portion to be pressed is completed.

Then, both the first die center portion 11 and the first die surrounding portions 12 are moved downward by the driving section 40, and the second bent portion 31B is pressed by the pressing portion 14 of the first die 10 while the first bent portions 31A are held by the holding portions 20B as shown in FIG. 8 in Step S22 for the deformation. As a result, the second bent portion 31B deforms so as to bend downward. On this occasion, the material flows in the portion to be pressed 31, but a flow of the material toward the outsides of the holding portions 20B (namely toward the surrounding portions 32 and 33) is suppressed by the first bent portions 31A being held by the holding portions 20B, and an excessive amount of the material is prevented from unevenly being distributed to the both sides of the portion to be pressed 31. Moreover, the material is also prevented from entering the surrounding portions 32 and 33 by the ends of the surrounding portions 32 and 33 connected to the portion to be pressed 31 being sandwiched by the first die surrounding portions 12 and the second die surrounding portions 22. An excessive amount of the material is prevented from being unevenly distributed in the center portion of the portion to be pressed 31 by the second bent portion 31B being pressed by the pressing portion 14. Then, the movements of the first die center portion 11 and the first die surrounding portions 12 are stopped when these portions are moved downward until the height H of the portion to be pressed 31 disappears as shown in FIGS. 9 and 10, and the press forming is completed. A distance L1 between the pressing portion 14 and a portion of the second die 20 opposing the pressing portion 14 (bottom surface of the recessed groove on the lower press forming surface 20A) and a distance L2 between the bottom surface of the holding portion 20B and a portion of the first die 10 opposing the bottom surface of the holding portion 20B (the protruded portion on the upper press forming surface 10A) are the same when the pressing is completed as shown in an enlarged view in FIG. 11.

Figure 11:
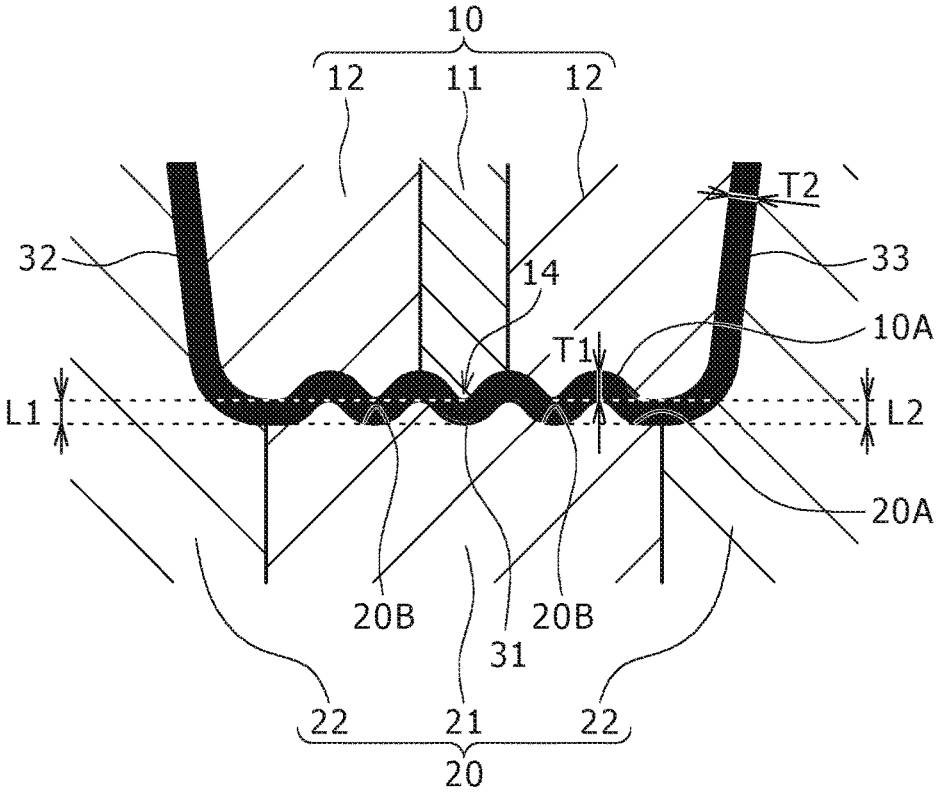
FIG. 11 is an enlarged view of a region XI in FIG. 10.

As described above, the portion to be pressed 31 is thickened as the height H decreases by applying the press forming to the portion to be pressed 31 in the height direction (namely, the up/down direction) while the material is prevented from flowing toward the surrounding portions 32 and 33. As a result, a plate thickness T1 of the portion to be pressed 31 is thickened more than a plate thickness T2 of the surrounding portions 32 and 33 (portions other than the portion to be pressed 31), resulting in manufacturing of a partially thickened press-formed article as shown in FIG. 11. On this occasion, the plate thicknesses T1 and T2 are respectively the thinnest plate thicknesses (lowest plate thicknesses) of the portion to be pressed 31 and the surrounding portions 32 and 33. Moreover, the protruded and recessed region 91A in the shape along the protruded and recessed surfaces of the upper and lower press forming surfaces 10A and 20A is formed simultaneously with the thickening on the portion to be pressed 31 after the forming. The first die 10 is moved upward by the driving section 40, and the press-formed article is taken out after the press forming is completed in this way.

[Press-Formed Article]

A description will now be given of the press-formed article 90 according to this embodiment referring to FIG. 12. The press-formed article 90 is a component used as a frame member of an automobile such as a front pillar, a cross member, and a side sill, and is manufactured by the manufacturing method of a press-formed article according to this embodiment.

Figure 12:
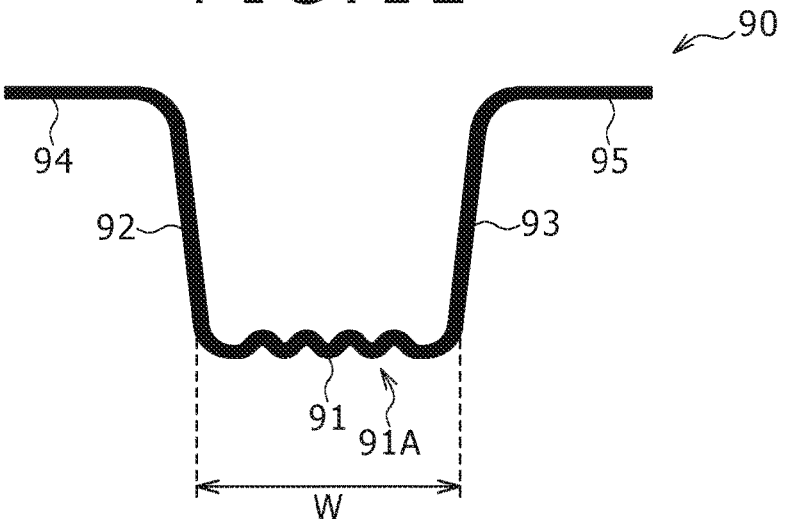
FIG. 12 is a view of a press-formed article according to the first embodiment of the present invention.

The press-formed article 90 has the shape machined into the hat shape, and includes a top plate portion 91 thickened by the press forming applied to the portion to be pressed 31, vertical wall portions 92 and 93 connected to respective ends of the top plate portion 91, and flange portions 94 and 95 connected to ends (ends on opposite sides of the sides connecting to the top plate portion 91) of the vertical wall portions 92 and 93 as shown in FIG. 12. The vertical wall portions 92 and 93 and the flange portions 94 and 95 are portions corresponding to the surrounding portions 32 and 33 (see FIG. 1.), and are less in the plate thickness than the top plate portion 91. In other words, the press-formed article 90 is partially thickened at the top plate portion 91. Moreover, the continuous protruded and recessed region 91A is formed so as to follow the protruded and recessed surfaces of the press forming surfaces 10A and 20A of the first die 10 and the second die 20 on the top plate portion 91 (thickened portion) as shown in FIG. 12. This protruded and recessed region 91A is a portion in a wave shape formed so as to repeat in a sufficiently small width than a width W in the left/right direction in FIG. 12 of the top plate portion 91. The strength in the thickened portion 91 is increased by providing the protruded and recessed region 91A compared with a case where the region is in a flat surface shape.

[Operations and Effects]

A description will now be given of characteristics and operations/effects of a press forming apparatus 1 and the manufacturing method of a press-formed article according to this embodiment.

The press forming apparatus 1 is an apparatus for manufacturing the press-formed article 90 by applying the press forming to the portion to be pressed 31 in the bent shape (curved shape) formed on the member to be pressed 30 in the plate shape. The press forming apparatus 1 includes the first die 10 that has the upper press forming surface 10A, the second die 20 that has the lower press forming surface 20A opposing the upper press forming surface 10A, and forms the press space S for storing the portion to be pressed 31 in the gap with the first die 10, and the driving section 40 that relatively moves the first die 10 and the second die 20 so as to approach each other, thereby decreasing the press space S. The groove-shaped holding portions 20B are provided on the second die 20 so as to be separated from each other for holding the two first bent portions 31A on the portion to be pressed 31. The first die 10 includes the pressing portion 14 that is positioned between the two holding portions 20B, has the shape protruding toward the second die 20, and presses the second bent portion 31B on the portion to be pressed 31.

The manufacturing method of a press-formed article is the method of manufacturing the press-formed article 90 by applying the press forming to the portion to be pressed 31 in the curved shape formed on the member to be pressed 30 in the plate shape. The manufacturing method includes Step S10 of arranging the member to be pressed 30 between the first die 10 and the second die 20, and Step S20 for relatively moving the first die 10 and the second die 20 so as to approach each other, thereby applying the press forming to the portion to be pressed 31 so that the height H of the portion to be pressed 31 decreases. In Step S20 for applying the press forming, while the pair of first bent portions 31A each bent in the protruded shape toward the second die 20 on the portion to be pressed 31 are held by the pair of holding portions 20B each in the groove shape provided so as to be separated from each other on the second die 20, the second bent portion 31B bent in the protruded shape from the position between the first bent portions 31A toward the first die 10 on the portion to be pressed 31 is pressed by the pressing portion 14 of the first die 10, thereby deforming the second bent portion 31B so as to thicken the portion to be pressed 31.

With the above-mentioned characteristic, the thickened portion can be formed by constructing the portion to be pressed 31 in the bent shape so as to secure the line length required for the thickening, and applying the press forming so as to decrease the height H of the portion to be pressed 31. Therefore, a longer line length required for the thickening can be secured compared with the case of the comparative example shown in FIG. 2 where the microbead 310A is formed on the portion to be pressed 310 in the flat plate shape, and the press-formed article 90 more in the thickened amount can be manufactured. Moreover, the second bent portion 31B provided between the first bent portions 31A is pressed by the pressing portion 14 of the first die 10 while the first bent portions 31A are held by the holding portions 20B of the second die 20 during the press forming of the portion to be pressed 31. As a result, the material can be prevented from unevenly being distributed to the both sides or the center portion of the portion to be pressed 31. An intended thickened amount can be obtained, and a local thinning that may be a start point of a crack in the press-formed article 90 can be prevented by controlling the flow of the material during the press forming in this way. As a result, the press-formed article in a desired shape can appropriately be obtained.

In the manufacturing method of a press-formed article, in Step S20 for applying the press forming, the press forming is applied to the portion to be pressed 31 so as to increase in the plate thickness more than the portions (surrounding portions 32 and 33) other than the portion to be pressed 31 in the member to be pressed 30. As a result, the press-formed article 90 increased in the strength can be manufactured by partially forming the thickened portion.

In the manufacturing method of a press-formed article, in Step S20 for applying the press forming, the press forming is applied to the portion to be pressed 31 until the height H of the portion to be pressed 31 disappears after the forming, in other words, the ends of the surrounding portions 32 and 33 connected to the portion to be pressed 31 and the portion to be pressed 31 are approximately at the same positions in the up/down direction. As a result, the thickened amount on the portion to be pressed 31 can be increased, and the press-formed article 90 increased more in the strength can be manufactured.

In the manufacturing method of a press-formed article, the member to be pressed 30 includes the surrounding portions 32 and 33 connected to the ends of the portion to be pressed 31. In Step S20 for applying the press forming, the portions of the surrounding portions 32 and 33 connected to the portion to be pressed 31 are sandwiched by the first die 10 (first die surrounding portions 12) and the second die 20 (second die surrounding portions 22). As a result, the flow of the material from the ends of the portion to be pressed 31 toward the center portion can be promoted during the press forming, thereby more effectively suppressing the uneven distribution of an excessive amount of the material to the ends of the portion to be pressed 31.

In the manufacturing method of a press-formed article, in Step S20 for applying the press forming, the first bent portions 31A and the second bent portion 31B are formed on the portion to be pressed 31. More specifically, Step S20 for applying the press forming includes the bending step S21 for forming the first bent portions 31A and the second bent portion 31B on the portion to be pressed 31, and the deformation step S22 for pressing and deforming the second bent portion 31B while the first bent portions 31A are held by the holding portions 20B. The formation of the first and second bent portions 31A and 31B on the portion to be pressed 31 during the press forming in this way can eliminate the necessity of the formation of the first and second bent portions 31A and 31B in advance before the press forming, thereby increasing the efficiency of the manufacturing process.

In the manufacturing method of a press-formed article, the first die 10 includes the first die center portion 11 including the pressing portion 14, and the first die surrounding portions 12 formed independently of the first die center portion 11, and configured to move independently of the first die center portion 11. In Step S20 for applying the press forming, after the first bent portions 31A and the second bent portion 31B are formed on the portion to be pressed 31 by moving the first die surrounding portions 12, the second bent portion 31B is pressed and deformed by the pressing portion 14. More specifically, in Step S21 for the bending, the first bent portions 31A and the second bent portion 31B are formed on the portion to be pressed 31 by moving downward the first die surrounding portions 12. Then, the second bent portion 31B is pressed and deformed by the pressing portion 14 by downward moving the first die center portion 11 in Step S22 for the deformation. As a result, the first die center portion 11 can be started to move after the second bent portion 31B is formed on the portion to be pressed 31 during the press forming, thereby using the pressing portion 14 to surely press the second bent portion 31B.

In the manufacturing method of a press-formed article, the distance L1 between the pressing portion 14 and the second die 20 and the distance L2 between the holding portions 20B and the first die 10 are the same when Step S20 for the press forming is completed. As a result, the thickness of the portion to be pressed 31 can be uniform.

In the manufacturing method of a press-formed article, in Step S20 for applying the press forming, the protruded and recessed region 91A is provided on the portion to be pressed 31. As a result, the press-formed article 90 reinforced by the protruded and recessed region 91A and thus increased in the strength can be manufactured.

In the manufacturing method of a press-formed article, the member to be pressed 30 may be formed by the hot pressing. The flow of the material in the portion to be pressed 31 can be controlled according to this embodiment as described above, and the intended thickened amount can be thus obtained even in the case of the hot pressing in which the material is likely to flow during the press forming.

(Variation)

The protruded and recessed region 91A can be provided without changing the plate thickness of the portion to be pressed 31 before and after the pressing in Step S22 for the deformation according to the first embodiment. The strength of the press-formed article can be secured by providing the protruded and recessed region 91A even in this case. The same holds true for the following embodiments. It should be noted that a height in the up/down direction (refer to FIG. 9) of a protruded and recessed portion of the protruded and recessed region 91A, namely a distance between a top and a bottom, is more than that in the case where the portion to be pressed 31 is thickened. The portion to be pressed 31 only needs not to be decreased in the plate thickness by the press forming in this way, and the press forming may be applied for the thickening as in the first embodiment, or the press forming may be applied so as to maintain a constant plate thickness of the portion to be pressed 31.

Second Embodiment

A description will now be given of a press forming apparatus 2 and a manufacturing method of a press-formed article according to a second embodiment of the present invention with reference to FIGS. 13 to 18. It should be noted that only points different from the first embodiment will be detailed in the second embodiment.

[Press Forming Apparatus]

Figure 13:
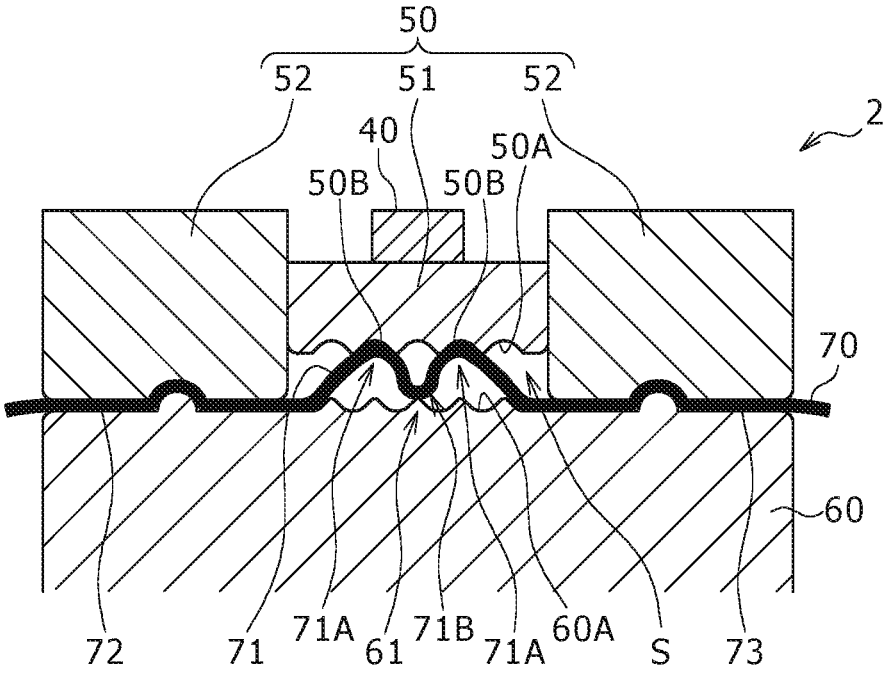
FIG. 13 is a view of the configuration of a press forming apparatus according to a second embodiment of the present invention.
Figure 14:
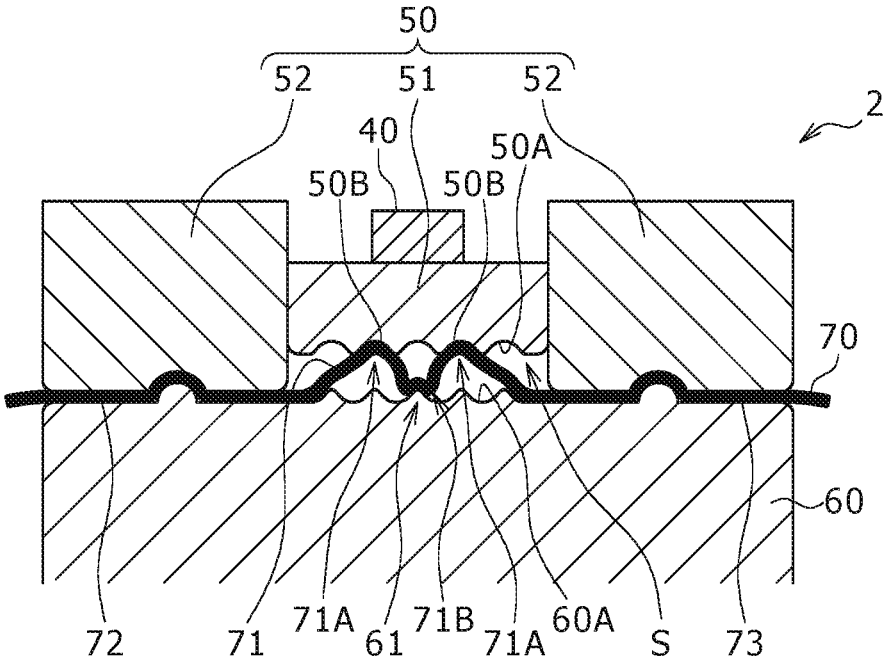
FIG. 14 is a view of a state where the press forming is applied to a portion to be pressed by the press forming apparatus.
Figure 15:
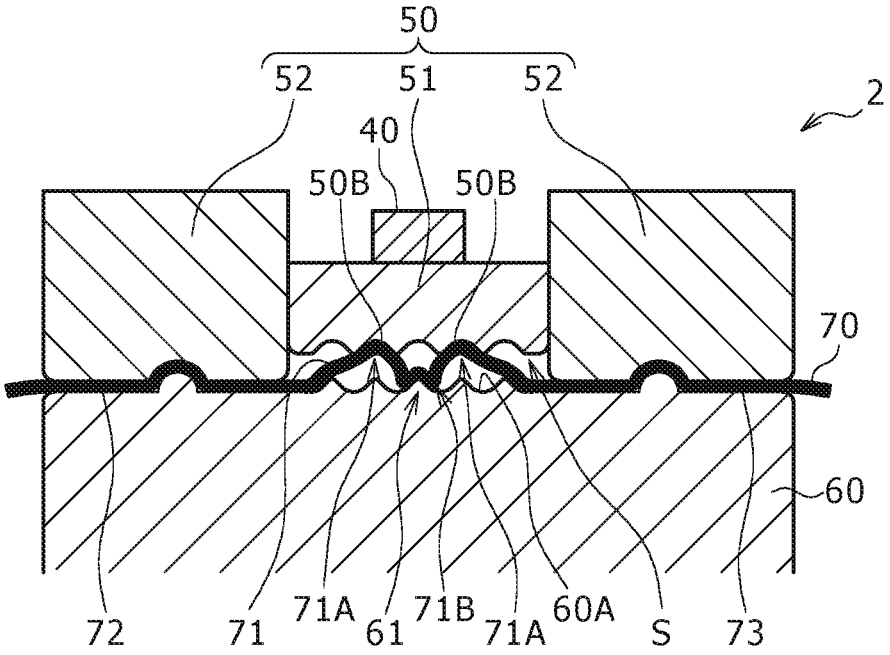
FIG. 15 is a view of a state where the press forming is applied to the portion to be pressed by the press forming apparatus.
Figure 16:
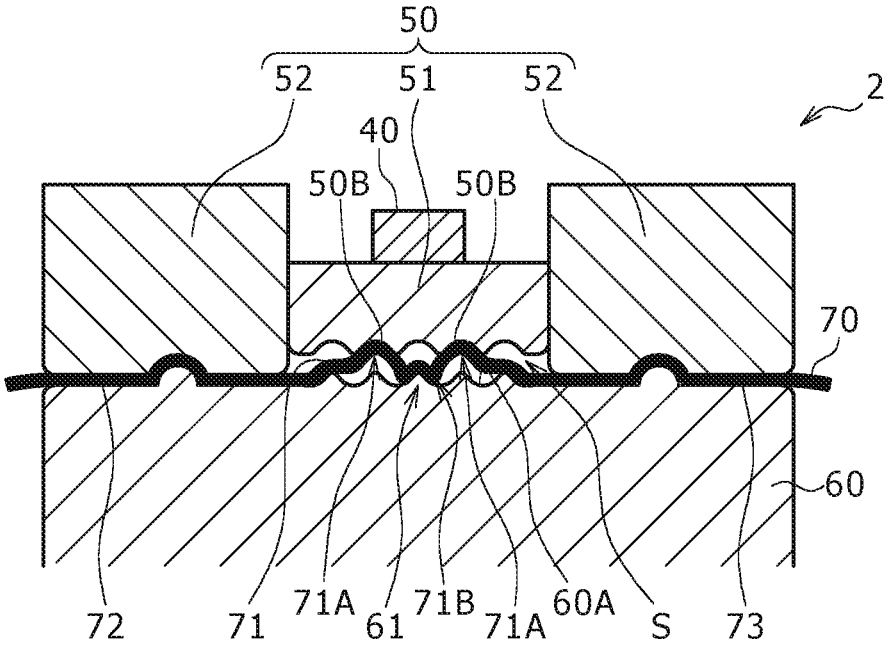
FIG. 16 is a view of a state where the press forming is applied to the portion to be pressed by the press forming apparatus.
Figure 17:
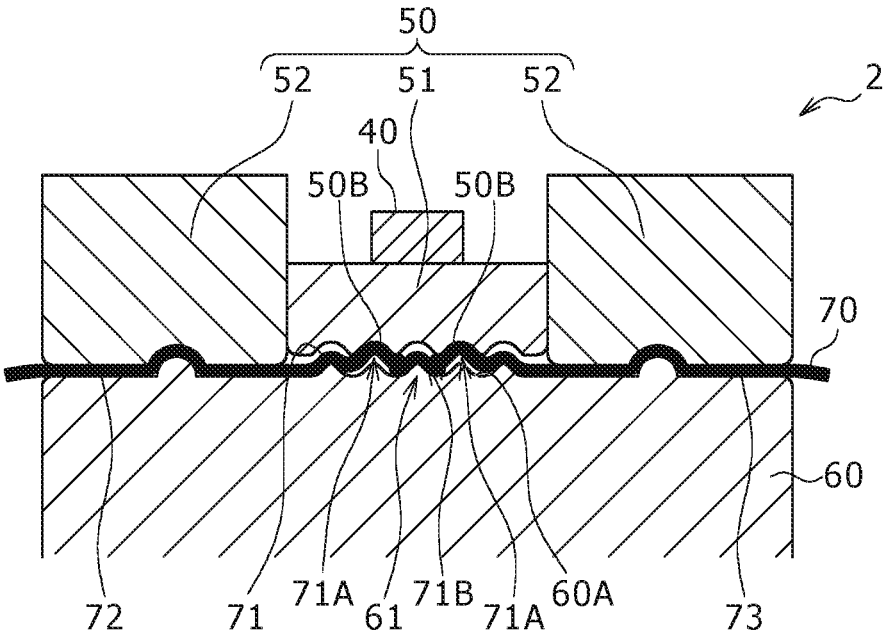
FIG. 17 is a view of a state where the press forming is applied to the portion to be pressed by the press forming apparatus.

The press forming apparatus 2 is an apparatus for manufacturing a press-formed article by applying the press forming to a portion to be pressed 71 bent in an M shape in the cross sectional view formed on a member to be pressed 70 in a plate shape as shown in FIG. 13. The line length of the portion to be pressed 71 is more than the length along the protruded and recessed region 91A on the press-formed article 90 shown in FIG. 12 as in the first embodiment. The press forming apparatus 2 includes an upper die 50, a lower die 60, and the driving section 40. A pressing portion 61 is provided on the lower die 60 as described later according to the second embodiment, and the lower die 60 corresponds to the first die 10 on which the pressing portion 14 shown in FIG. 1 is provided. The lower die 60 is referred to as "first die 60" hereinafter. Holding portions 50B are provided on the upper die 50, and the upper die 50 corresponds to the second die 20 on which the holding portions 20B shown in FIG. 1 are provided. The upper die 50 is referred to as "second die 50" hereinafter. The driving section 40 moves the second die 50 so as to approach the first die 60 or so as to depart from the first die 60 in the up/down direction. In other words, the second die 50 is moved upward/downward while the position of the first die 60 is fixed according to the second embodiment, which is different from the first embodiment.

The second die 50 includes a second die center portion 51 in a block shape on which an upper press forming surface 50A in a wave shape is formed and second die surrounding portions 52 each in a block shape arranged so as to sandwich both side surfaces of the second die center portion 51. The driving section 40 is arranged on a top portion of the second die center portion 51, and the second die center portion 51 is configured to be upward/downward moved by the driving section 40. The upper press forming surface 50A is constructed by a continuous protruded and recessed region, and two recessed grooves constitute the holding portions 50B provided so as to be separated from each other, thereby existing on both sides of a center recessed groove. Two first bent portions 71A formed on the portion to be pressed 71 can be held by the holding portions 50B. The second die center portion 51 corresponds to the upper forming die portion and the second die surrounding portions 52 correspond to the upper sandwiching die portions according to this embodiment.

The first die 60 includes a lower press forming surface 60A in a wave shape opposing the upper press forming surface 50A. The portion to be pressed 71 is stored in the press space S formed between the upper press forming surface 50A and the lower press forming surface 60A, and surrounding portions 72 and 73 are arranged between the second die surrounding portions 52 and the first die 60. The lower press forming surface 60A includes a pressing portion 61 in a shape protruding toward the second die 50 at its center, and can use the pressing portion 61 to press a second bent portion 71B formed on the portion to be pressed 71. The pressing portion 61 is a part of the first die 60 according to this embodiment, and the pressing portion 61 integrally moves with other die portions, which is different from the first embodiment.

Moreover, a portion on which the lower press forming surface 60A is formed at the center portion of the first die 60 corresponds to the lower forming die portion, and portions on both sides thereof correspond to the lower sandwiching die portions according to this embodiment. In other words, the lower forming die portion and the lower sandwiching die portions are integrally formed as the single first die 60 according to this embodiment, which is different from the first embodiment.

[Manufacturing Method of Press-Formed Article]

A description will now be given of the manufacturing method of a press-formed article carried out by using the press forming apparatus 2.

Figure 5:
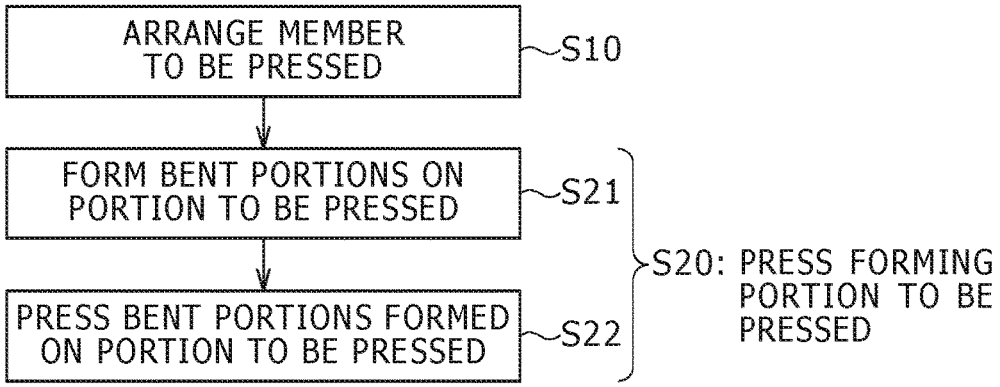
FIG. 5 is a flowchart of a manufacturing method of a press-formed article according to the first embodiment of the present invention.

First, the member to be pressed 70, on which the first bent portions 71A and the second bent portion 71B are formed in advance by bending on the portion to be pressed 71, is prepared, is brought into a softened state by heating, and then is arranged between the second die 50 and the first die 60 as shown in FIG. 13 in Step S10 (see FIG. 5.). On this occasion, the portion to be pressed 71 is positioned in the press space S, and the surrounding portions 72 and 73 are sandwiched and fixed by the second die surrounding portion 52 and the first die 60. Moreover, there is brought about such a state that the first bent portions 71A are fit into the holding portions 50B of the second die 50, and the second bent portion 71B abuts against the pressing portion 61 of the first die 60.

Figure 18:
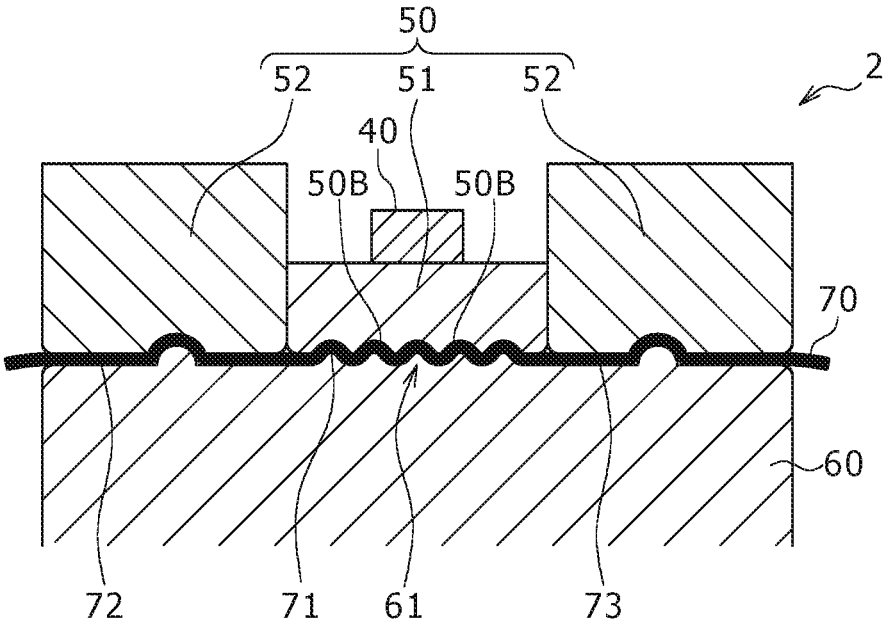
FIG. 18 is a view of a state where the press forming for the portion to be pressed is completed.

Then, the press space S is decreased by using the driving section 40 to move down the second die center portion 51 toward the first die 60 in Step S20 (see FIG. 5.). As a result, the height H of the portion to be pressed 71 gradually decreases, thereby increasing the thickness of the portion to be pressed 71 in the state where the surrounding portions 72 and 73 are sandwiched as sequentially shown in FIGS. 14 to 18. On this occasion, a flow of an excessive amount of the material to outsides of the first bent portions 71A is suppressed by the first bent portions 71A being held by the holding portions 50B, and a distribution of an excessive amount of the material to the portion between the first bent portions 71A is suppressed by the second bent portion 71B being pressed by the pressing portion 61 as in the first embodiment. As a result, the press-formed article in the flat plate shape including the thickened portion on which the continuous protruded and the recessed region is formed is manufactured as shown in FIG. 18.

The member to be pressed 70 on which the first bent portions 71A and the second bent portion 71B are formed in advance on the portion to be pressed 71 is prepared, and the press-formed article is manufactured by applying the press forming to the member to be pressed 70 according to the second embodiment in this way. The first bent portions 71A can surely be formed at the positions opposing the holding portions 50B of the second die 50, and the second bent portion 71B can surely be formed at the position opposing the pressing portion 61 of the first die 60 by forming the first and second bent portions 71A and 71B on the portion to be pressed 71 in advance before the press forming in this way. As a result, the first bent portions 71A can more surely be held by the holding portions 50B, and the second bent portion 71B can more surely be pressed by the pressing portion 61 during the press forming.

It should be noted that the pressing portion 61 may be in contact with the second bent portion 71B in the state before the start of the pressing as shown in FIG. 13, but the configuration is not limited to this case, a gap may be formed between the pressing portion 61 and the second bent portion 71B in the state before the start of the press, and the pressing portion 61 may be brought in contact with the second bent portion 71B by moving down the second die center portion 51 during the pressing.

Third Embodiment

A description will now be given of a press forming apparatus 3 and a manufacturing method of a press-formed article according to a third embodiment of the present invention with reference to FIG. 19. It should be noted that only points different from the first embodiment will be detailed in the third embodiment.

Figure 19:
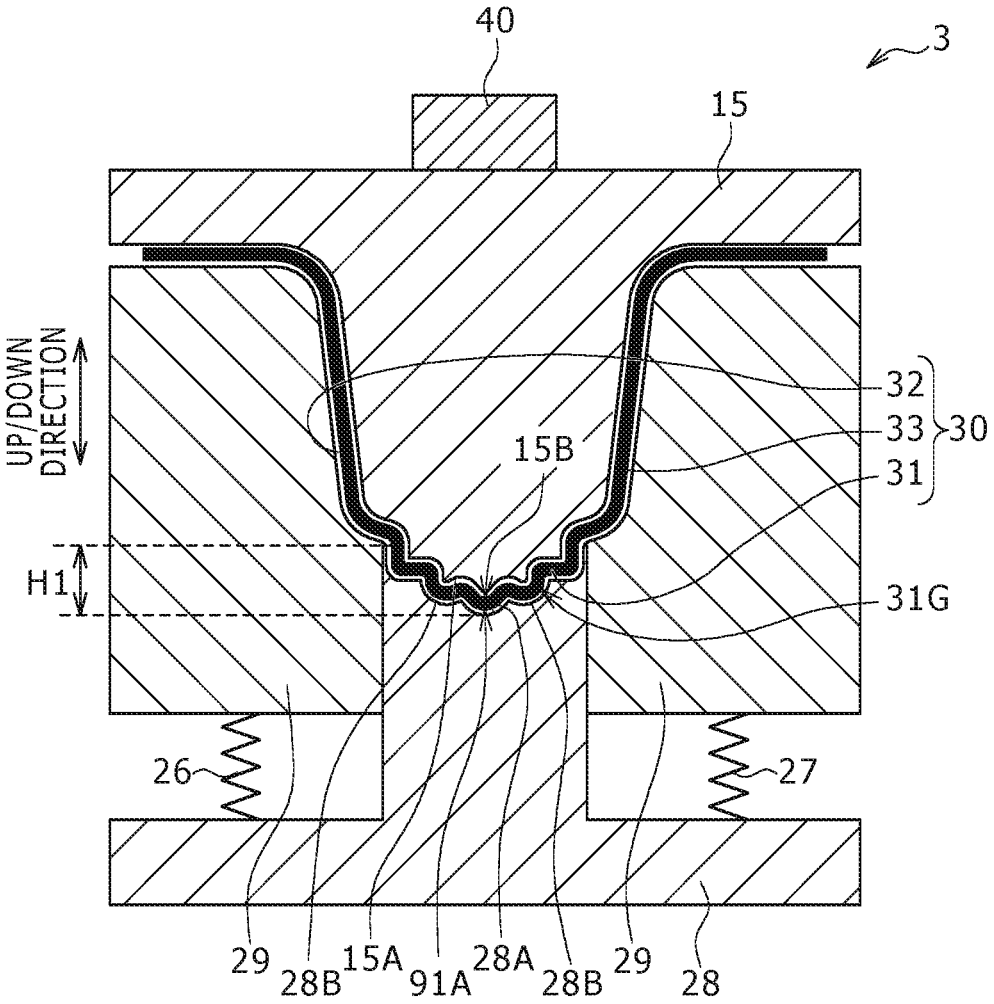
FIG. 19 is a view of the configuration of a press forming apparatus according to a third embodiment of the present invention.

A first die 15 (upper die) includes an upper press forming surface 15A in a wave shape, and the upper press forming surface 15A has a protruded shape at a center swelling out toward a second die center portion 28 (second die) in the press forming apparatus 3 as shown in FIG. 19. A pressing portion 15B is provided at a top of the upper press forming surface 15A as in the first embodiment. Moreover, the second die center portion 28 includes a lower press forming surface 28A in a wave shape opposing the upper press forming surface 15A, and the lower press forming surface 28A has a recessed shape so as to depart from the first die 15. Continuous protruded and recessed regions are formed on the upper and lower press forming surfaces 15A and 28A as in the first embodiment. Moreover, a pair of holding portions 28B is provided so as to be separated from each other on the lower press forming surface 28A as in the first embodiment.

The member to be pressed 30 is arranged so that the portion to be pressed 31 is positioned between the upper and lower press forming surfaces 15A and 28A, and the surrounding portions 32 and 33 are positioned between the first die 15 and the second die surrounding portions 29, and the press forming is applied to the portion to be pressed 31 by moving down the first die 15 in the press forming apparatus 3. As a result, the press forming is applied to the portion to be pressed 31 so as to have a bent shape 31G in a protruded shape toward the second die center portion 28 along the shapes of the upper and lower press forming surfaces 15A and 28A. The bent shape 31G is a shape curved so as to protrude toward the second die center portion 28 as shown in FIG. 19. Moreover, the protruded and recessed region 91A is simultaneously formed on the bent shape 31G. On this occasion, a height H1 of the portion to be pressed 31 after the forming is less than the height H (FIG. 1) of the portion to be pressed 31 in a trapezoidal shape before the forming. Moreover, a width of the bent shape 31G in the left/right direction of FIG. 19 is more than a width of the protruded and recessed region 91A. The press-formed article bent in the thickened portion can be manufactured by using the dies on which the press forming surfaces 15A and 28A in the shapes described above are formed according to this embodiment. Moreover, the press forming may be applied to the portion to be pressed 31 so as to include a bent shape protruded toward the first die 15 conversely in this embodiment.

Fourth Embodiment

Figure 20:
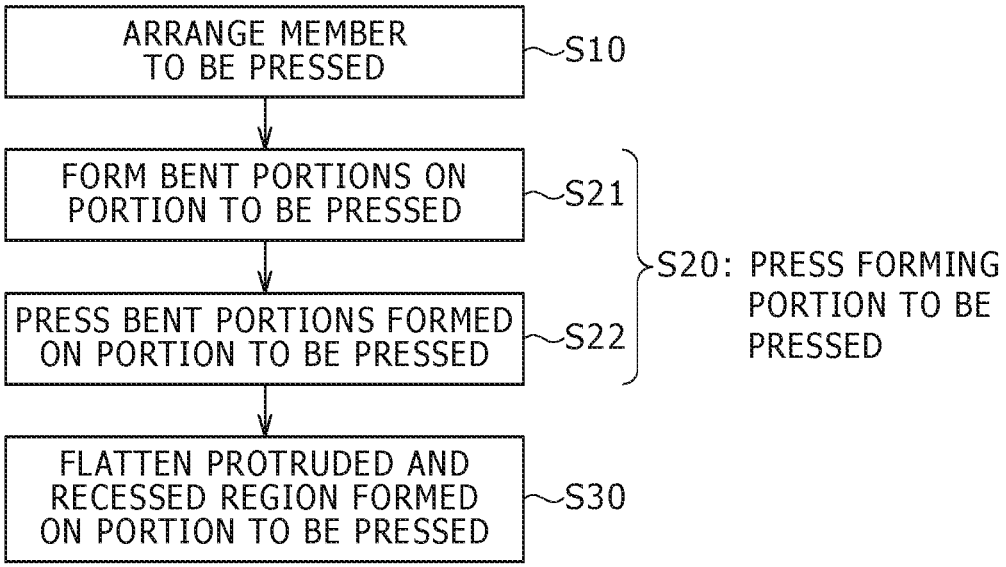
FIG. 20 is a flowchart of a manufacturing method of a press-formed article according to a fourth embodiment of the present invention.

A description will now be given of a manufacturing method of a press-formed article according to a fourth embodiment of the present invention with reference to a flowchart in FIG. 20. After Step S10 of arranging the member to be pressed 30 and Step S20 for applying the press forming to the portion to be pressed 31 are sequentially carried out as in the first embodiment, Step S30 of flattening the protruded and recessed region of the portion to be pressed 31 is further carried out according to the fourth embodiment as shown in FIG. 20.

Figure 21:
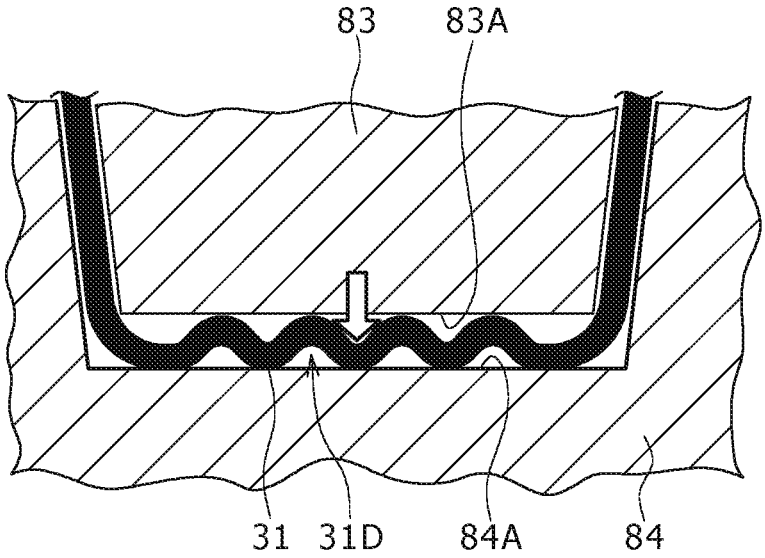
FIG. 21 is a view of a step of flattening a protruded and recessed region formed on a portion to be pressed.
Figure 22:
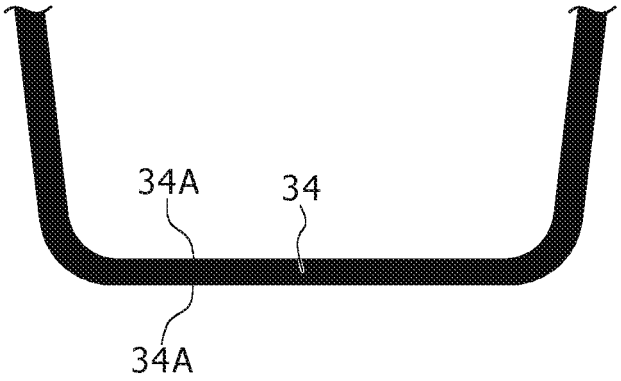
FIG. 22 is a view of a press-formed article including a flattened thickened portion.

Specifically, the protruded and recessed region 31D can be flattened by arranging the portion to be pressed 31 on which the continuous protruded and recessed region 31D is formed between dies 83 and 84 including press forming surfaces 83A and 84A each in a flat surface shape, and using the press forming surfaces 83A and 84A to press the portion to be pressed 31 in the thickness direction as shown in FIG. 21. As a result, a press-formed article including a thickened portion 34 on which the protruded and recessed region disappears, and a flat surface 34A is formed can be manufactured as shown in FIG. 22. The plate material can be prevented from being buckled by flattening the protruded and recessed region 31D after once forming the protruded and recessed region 31D on the portion to be pressed 31 in this way, which is different from the case where the portion to be pressed 31 is directly formed into the flat shape. A step of using dies and the like to press and flatten the protruded and recessed region 91A in the thickness direction after the protruded and recessed region 91A is formed on the bent shape 31G may be carried out also according to the third embodiment as in the fourth embodiment.

Other Embodiments

Finally, a description is given of other embodiments of the present invention.

Figure 23:
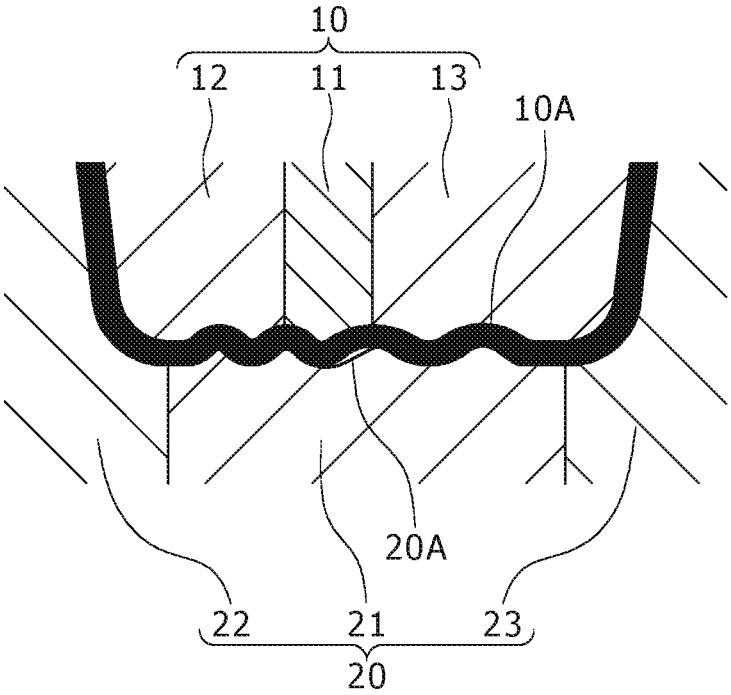
FIG. 23 is an enlarged view of a press forming apparatus according to another embodiment of the present invention.
Figure 24:
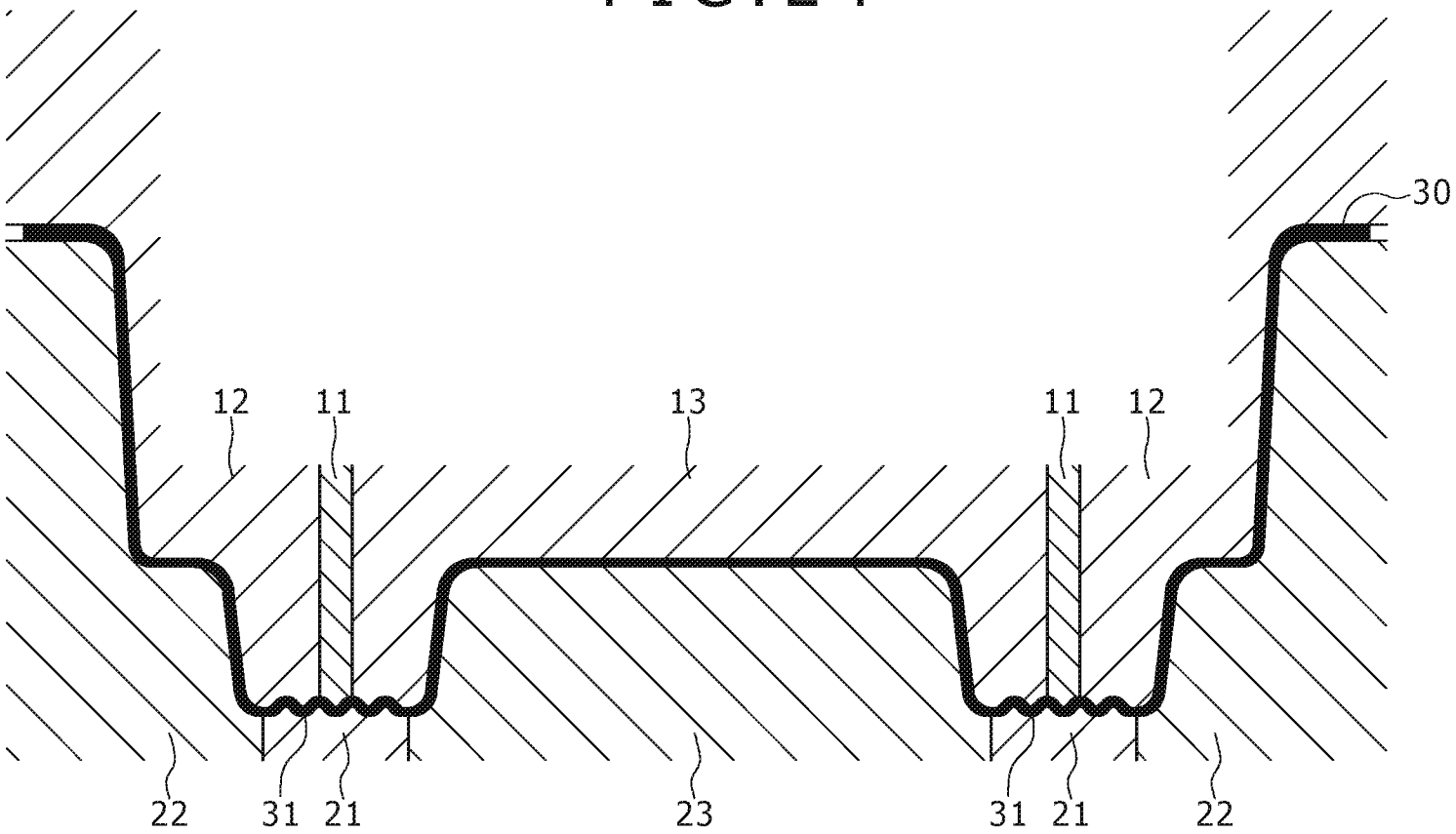
FIG. 24 is a view of a press forming apparatus according to another embodiment of the present invention.

The protruded and recessed shapes on the upper press forming surface 10A of the first die 10 and the lower press forming surface 20A of the second die 20 may be left-right asymmetric in the cross sectional view as shown in FIG. 23. In other words, the width of the recessed grooves may not be the same over the entire surface. Moreover, a plurality (two) of portions to be pressed 31 may be formed on the member to be pressed 30, and a press-formed article on which a plurality of thickened portions are formed may be manufactured by applying the press forming to the portions to be pressed 31 as shown in FIG. 24. The number of provided portions to be pressed 31 may be equal to or more than three.

The portion to be pressed is not necessarily be uniformly thickened as long as the desired strength is provided for the press-formed article according to the first embodiment. The same holds true for the other embodiments.

The configuration according to the first embodiment is not limited to the case where the second bent portion 31B is formed at the center of the portion to be pressed 31, and the second bent portion 31B may be formed at a position closer to one of the ends of the portion to be pressed 31 rather than at the center thereof. Moreover, the configuration is not limited to the case where only the pair of first bent portions 31A and the one second bent portion 31B positioned therebetween are formed on the portion to be pressed 31, and a plurality of pairs of first bent portions 31A and the second bent portions 31B respectively positioned therebetween may be formed.

The configuration according to the first embodiment is not limited to the case where only the first die 10 moves, and the second die 20 may move upward, or both the first die 10 and the second die 20 may move. The first die center portion 11 and the first die surrounding portions 12 may be integrated with each other.

It should be considered that the embodiments disclosed herein are exemplary in all respects, and are not limitative. The scope of the present invention is not represented by the above description but by the scope of claims, and it is intended that connotation equivalent to the scope of claims, and all changes within the scope are included.

What is claimed is:

1. A method of manufacturing a press-formed article by press forming a bent-shaped portion to be pressed that is formed on a plate-shaped member to be pressed comprising the steps of:

arranging the member to be pressed between a first die and a second die where the first die includes a pressing portion and the second die includes a press forming surface provided with at least two groove-shaped holding portions, separated from each other by a predetermined distance; and press forming the portion to be pressed so that a height of the portion to be pressed decreases by moving the first die and the second die relative to each other so as to approach each other, wherein in the press forming step, a pair of first bent portions each protruding toward the second die and a second bent portion protruding towards the first die between the pair of first bent portions are formed on the portion to be pressed as the portion to be pressed is pressed against the two groove-shaped holding portions formed on the second die;

the second bent portion formed between the first bent portions is pressed toward the second die and deformed by the pressing portion of the first die so that the middle of the second bent portion is further bent toward the second die.

2. The method of manufacturing a press-formed article according to claim 1, wherein in the press forming step, the portion to be pressed is thickened.

3. The method of manufacturing a press-formed article according to claim 1, wherein in the press forming step, the portion to be pressed is press formed until the height of the portion to be pressed disappears after the press forming.

4. The method of manufacturing a press-formed article according to claim 1, wherein in the press forming step, the portion to be pressed is press formed so that the portion to be pressed after the press forming has a bent shape less in the height than that before the press forming.

5. The method of manufacturing a press-formed article according to claim 1, wherein in the press forming step, a surrounding portion of the portion to be pressed out of the member to be pressed is sandwiched by the first die and the second die.

6. The method of manufacturing a press-formed article according to claim 1, wherein in the press forming step, the first bent portions and the second bent portion are formed on the portion to be pressed.

7. The method of manufacturing a press-formed article according to claim 6, wherein the first die includes a first die center portion including the pressing portion, and a first die surrounding portion formed separately from the first die center portion and configured to move independently of the first die center portion, and wherein in the press forming step, after the first die surrounding portion is moved toward the second die to form the first bent portions and the second bent portion on the portion to be pressed, the second bent portion is pressed and deformed by the pressing portion.

8. The method of manufacturing a press-formed article according to claim 1, wherein a distance between the pressing portion and the second die and a distance between the holding portions and the first die are the same when the press forming step is completed.

9. The method of manufacturing a press-formed article according to claim 1, wherein in the press forming step, a protruded and recessed region is provided on the portion to be pressed.

10. The method of manufacturing a press-formed article according to claim 9, further comprising the step of:

flattening the protruded and recessed region after the press forming step.

11. The method of manufacturing a press-formed article according to claim 1, wherein the member to be pressed is formed by hot pressing.

12. A press-formed article manufactured by the method of manufacturing a press-formed article according to claim 1.

13. A press forming apparatus manufacturing a press-formed article by press forming a bent-shaped portion to be pressed that is formed on a plate-shaped member to be pressed, comprising:

a first die that includes a first press forming surface;

a second die that includes a second press forming surface opposing the first press forming surface and forms a press space between the first die and the second die in which the portion to be pressed is stored, where the second press forming surface is provided with at least two groove-shaped holding portions, so as to be separated from each other by a predetermined distance; and a driving section that moves the first die and the second die relative to each other so as to approach each other, thereby decreasing the press space, wherein two first bent portions each protruding toward the second die and a second bent portion protruding towards the first die between the two first bent portions are formed on the portion to be pressed when the first die and the second die are driven by the driving section to move toward each other, and wherein the first die includes a pressing portion that is positioned between the two groove-shaped holding portions, has a shape protruding toward the second die, and presses the second bent portion on the portion to be pressed.

14. The press forming apparatus according to claim 13, wherein the first die includes a first die center portion including the pressing portion, and a first die surrounding portion formed separately from the first die center portion and configured to move independently of the first die center portion.

* * * * *